US007949287B2

(12) United States Patent
Ota

(10) Patent No.: US 7,949,287 B2
(45) Date of Patent: May 24, 2011

(54) DEVELOPER CARTRIDGE, IMAGE FORMING UNIT AND IMAGE FORMING APPARATUS

(75) Inventor: Atsushi Ota, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 12/491,429

(22) Filed: Jun. 25, 2009

(65) Prior Publication Data

US 2009/0263165 A1 Oct. 22, 2009

Related U.S. Application Data

(63) Continuation of application No. 11/534,421, filed on Sep. 22, 2006, now Pat. No. 7,574,161.

(30) Foreign Application Priority Data

Sep. 27, 2005 (JP) ..... 2005-279956

(51) Int. Cl.
*G03G 15/08* (2006.01)

(52) U.S. Cl. ..... 399/258; 399/260; 399/262

(58) Field of Classification Search ..... 399/120, 399/258, 260, 262, 106, 109
See application file for complete search history.

(56) References Cited

U.S. PATENT DOCUMENTS 5,089,854 A 2/1992 Kaieda et al.
5,351,728 A 10/1994 Ban et al.
5,548,384 A * 8/1996 Weed ..... 399/120
5,579,101 A * 11/1996 Omata et al. ..... 399/114
5,630,198 A * 5/1997 Makino ..... 399/120
5,771,427 A 6/1998 Makino
5,809,384 A * 9/1998 Johroku et al. ..... 399/262
5,848,338 A 12/1998 Okada (Continued)

FOREIGN PATENT DOCUMENTS

CN 1624598 A 6/2005

(Continued)

OTHER PUBLICATIONS

Chinese Office Action issued Jun. 3, 2010 (with English translation).

*Primary Examiner* — David M Gray
*Assistant Examiner* — Geoffrey T Evans
(74) *Attorney, Agent, or Firm* — Panitch Schwarze Belisario & Nadel LLP

(57) ABSTRACT

A developer cartridge includes an outer barrel member, an inner barrel member rotatably provided with respect to the outer barrel member, and a regulating member rotatably provided with respect to the inner barrel member. The regulating member includes a first engaging portion and a second engaging portion. The inner barrel member includes a first to-be-engaged portion that engages the first engaging portion and an operating member. The outer barrel member includes a second to-be-engaged portion that engages the second engaging portion. When the first engaging portion and the first to-be-engaged portion engage each other and engagement between the second engaging portion and the second to-be-engaged portion is released, the inner barrel member is rotatable together with the regulating member with respect to the outer barrel member. When engagement between the first engaging portion and the first to-be-engaged portion is released and engagement between the second engaging portion and the second to-be-engaged portion released, the regulating member is rotatable with respect to the inner barrel member.

13 Claims, 15 Drawing Sheets

U.S. PATENT DOCUMENTS

| | | | | |
|---|---|---|---|---|
| 6,021,292 | A * | 2/2000 | Nakajima et al. | 399/120 |
| 6,134,410 | A * | 10/2000 | Nakajima | 399/262 |
| 6,151,472 | A * | 11/2000 | Nakajima | 399/262 |
| 6,324,371 | B1 | 11/2001 | Okiyama et al. | |
| 6,332,065 | B1 * | 12/2001 | Howard | 399/106 |
| 6,363,233 | B1 * | 3/2002 | Nakajima | 399/120 |
| 6,363,235 | B1 * | 3/2002 | Chiesa et al. | 399/258 |
| 6,438,345 | B1 * | 8/2002 | Ban et al. | 399/262 |
| 6,496,671 | B2 * | 12/2002 | Nakajima | 399/120 |
| 6,934,490 | B2 * | 8/2005 | Koyama et al. | 399/120 |
| 7,006,779 | B2 * | 2/2006 | Otani | 399/258 |
| 7,171,132 | B2 * | 1/2007 | Yabuki et al. | 399/27 |
| 7,245,860 | B2 * | 7/2007 | Huang et al. | 399/262 |
| 7,426,356 | B2 * | 9/2008 | Ota | 399/120 |
| 7,577,385 | B2 * | 8/2009 | Ban et al. | 399/258 |
| 7,729,645 | B2 * | 6/2010 | Noguchi | 399/262 |
| 2002/0127029 | A1 | 9/2002 | Yamada et al. | |
| 2003/0031479 | A1 * | 2/2003 | Ito | 399/27 |
| 2003/0223782 | A1 * | 12/2003 | Ban et al. | 399/227 |
| 2004/0047651 | A1 * | 3/2004 | Koyama et al. | 399/120 |
| 2004/0223790 | A1 | 11/2004 | Hosokawa et al. | |
| 2004/0265010 | A1 * | 12/2004 | Otani | 399/258 |
| 2005/0123322 | A1 | 6/2005 | Okamoto et al. | |
| 2006/0280526 | A1 * | 12/2006 | Shimomura | 399/258 |
| 2009/0087215 | A1 * | 4/2009 | Sakuma | 399/105 |
| 2009/0087216 | A1 * | 4/2009 | Sakuma | 399/106 |
| 2009/0190963 | A1 * | 7/2009 | Nozawa | 399/262 |
| 2009/0238609 | A1 * | 9/2009 | Koido | 399/262 |
| 2009/0245854 | A1 * | 10/2009 | Sakuma | 399/106 |
| 2010/0272465 | A1 * | 10/2010 | Yamazaki | 399/106 |

FOREIGN PATENT DOCUMENTS

| | | | |
|---|---|---|---|
| EP | 0435596 | A2 | 7/1991 |
| EP | 1533664 | A1 | 5/2005 |
| JP | 09120206 | A | 5/1997 |
| JP | 11133713 | A | 5/1999 |
| JP | 2001222158 | A | 8/2001 |
| JP | 2003345112 | A | 12/2003 |
| JP | 2004170790 | A | 6/2004 |
| JP | 2005010561 | A | 1/2005 |

* cited by examiner

DEVELOPER CARTRIDGE, IMAGE FORMING UNIT AND IMAGE FORMING APPARATUS

CROSS-REFERENCE TO RELATED APPLICATIONS

This application is a Continuation of U.S. patent application Ser. No. 11/534,421, filed Sep. 22, 2006, the disclosure of which is incorporated herein by reference.

BACKGROUND OF THE INVENTION

This invention relates to a developer cartridge, an image forming unit and an image forming apparatus.

In a conventional electrophotographic image forming apparatus such as a printer, a copier, a facsimile, a combined machine or the like (for example, a printer), a surface of a photosensitive drum is uniformly charged by a charging roller. The surface of the photosensitive drum is exposed to the light by means of an LED head so that a latent image is formed thereon. The latent image is developed with toner (i.e., developer) that forms a thin layer on a developing roller and adheres to the latent image with static electricity. The developed image (i.e., toner image) is transferred to a recording medium by means of a transferring roller, and is fixed to the recording medium by means of a fixing device. After the transferring, the toner remaining on the photosensitive drum is removed by a cleaning blade.

The above described photosensitive drum, the charging roller, the developing roller, the cleaning blade and the like are integrated into one unit as an image forming unit (also referred to as an ID unit, a developing device or the like). A developer cartridge is constructed as a separate unit mountable to a main body of the image forming unit. When the toner in the image forming unit decreases after the printing operation is repeated, the developer cartridge is replaced for supplying the toner to the image forming unit.

The developer cartridge has a toner supplying opening formed on a position corresponding to a toner receiving opening formed on the main body of the image forming unit. The developer cartridge also has a shutter portion for opening and closing the toner supplying opening. An operation lever is provided on an end of the developer cartridge and is integrally formed with the shutter portion. When the operation lever is rotated, a rib formed on the main body of the image forming unit is guided by a guide groove formed on the operation lever, and the developer cartridge is mounted to the main body of the image forming unit. In this state, the toner can be supplied to the main body of the image forming unit. Such a printer is disclosed in, for example, Japanese Laid-Open Patent Publication No. 11-133713.

However, in the conventional printer, when the image forming unit is packed and shipped in such a manner that the developer cartridge is mounted to the main body of the image forming unit, there is a possibility that the toner may leak outside through a joint portion between the toner cartridge and the main body of the image forming unit during transport.

Accordingly, the image forming unit and the developer cartridge are individually packed and shipped, and therefore costs of the image forming unit and the printer (i.e., the image forming apparatus) increase.

BRIEF SUMMARY OF THE INVENTION

An object of the present invention is to provide a developer cartridge, an image forming unit and an image forming apparatus capable of preventing the leakage of toner during transport to thereby reduce the cost.

The present invention provides a developer cartridge including an outer barrel member, an inner barrel member rotatably provided with respect to the outer barrel member, and a regulating member rotatably provided with respect to the inner barrel member. The regulating member includes a first engaging portion and a second engaging portion. The inner barrel member includes a first to-be-engaged portion that engages the first engaging portion and an operating member. The outer barrel member includes a second to-be-engaged portion that engages the second engaging portion. When the first engaging portion and the first to-be-engaged portion engage each other and engagement between the second engaging portion and the second to-be-engaged portion is released, the inner barrel member is rotatable together with the regulating member with respect to the outer barrel member. When engagement between the first engaging portion and the first to-be-engaged portion is released and engagement between the second engaging portion and the second to-be-engaged portion released, the regulating member is rotatable with respect to the inner barrel member.

With such an arrangement, in the manufacturing process, it becomes possible to pack and ship the image forming unit in such a manner that the developer cartridge is mounted to the main body of the image forming unit, with the developer supplying portion being closed. Further, it becomes possible to pack and ship the image forming apparatus in such a manner that the image forming unit is mounted to a main body of the image forming apparatus. Further, the leakage of the toner during transport can be prevented.

Furthermore, since it is not necessary to individually pack and ship the image forming unit and the developer cartridge, the costs of the image forming unit and the image forming apparatus can be reduced.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Embodiments of the present invention will be described with reference to the attached drawings. As an example of an image forming apparatus, a color printer that forms (i.e., prints) a color image will be described.

First Embodiment

Figure 1:
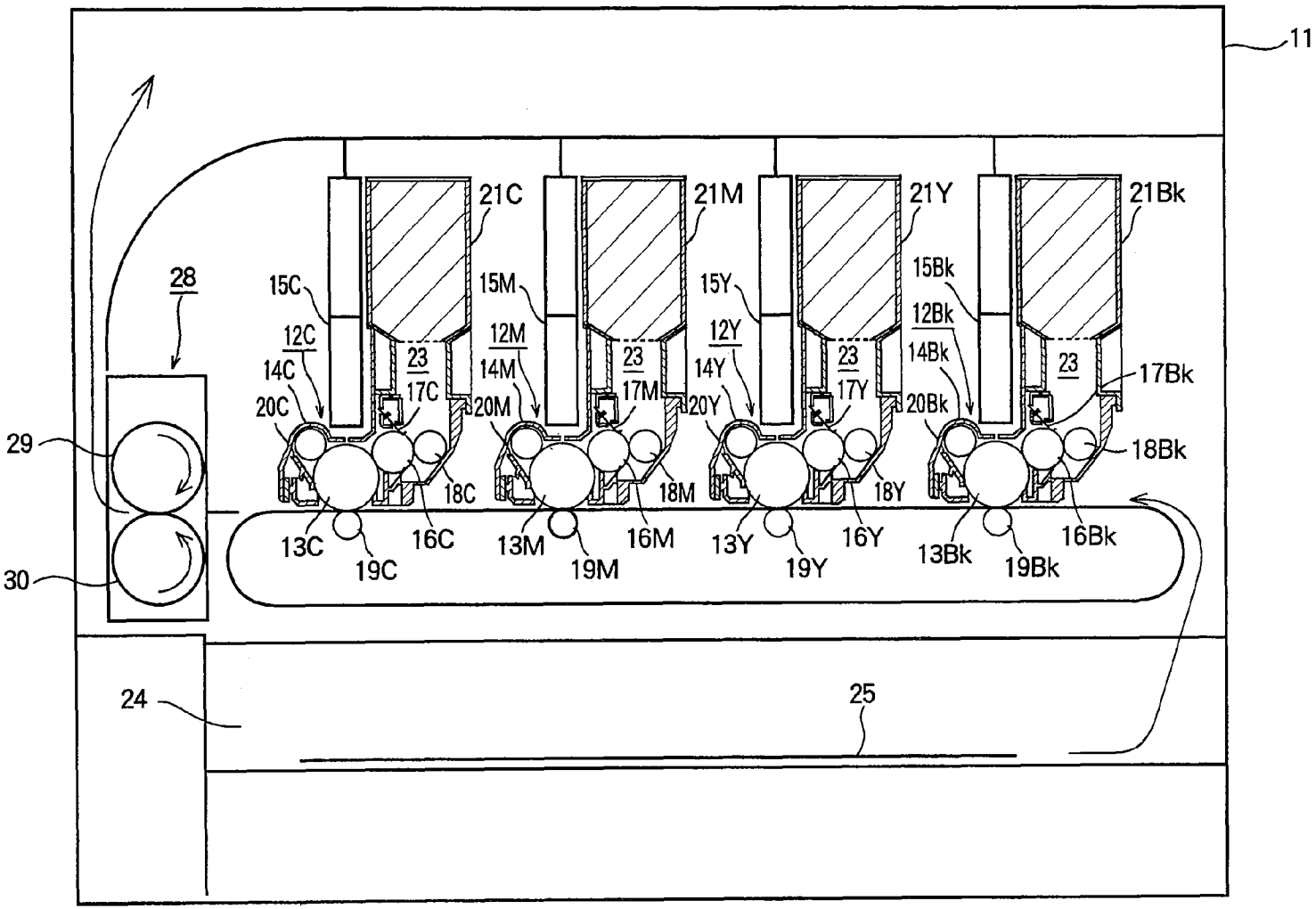
FIG. 1 is a schematic view of a printer according to the first embodiment of the present invention.
Figure 2:
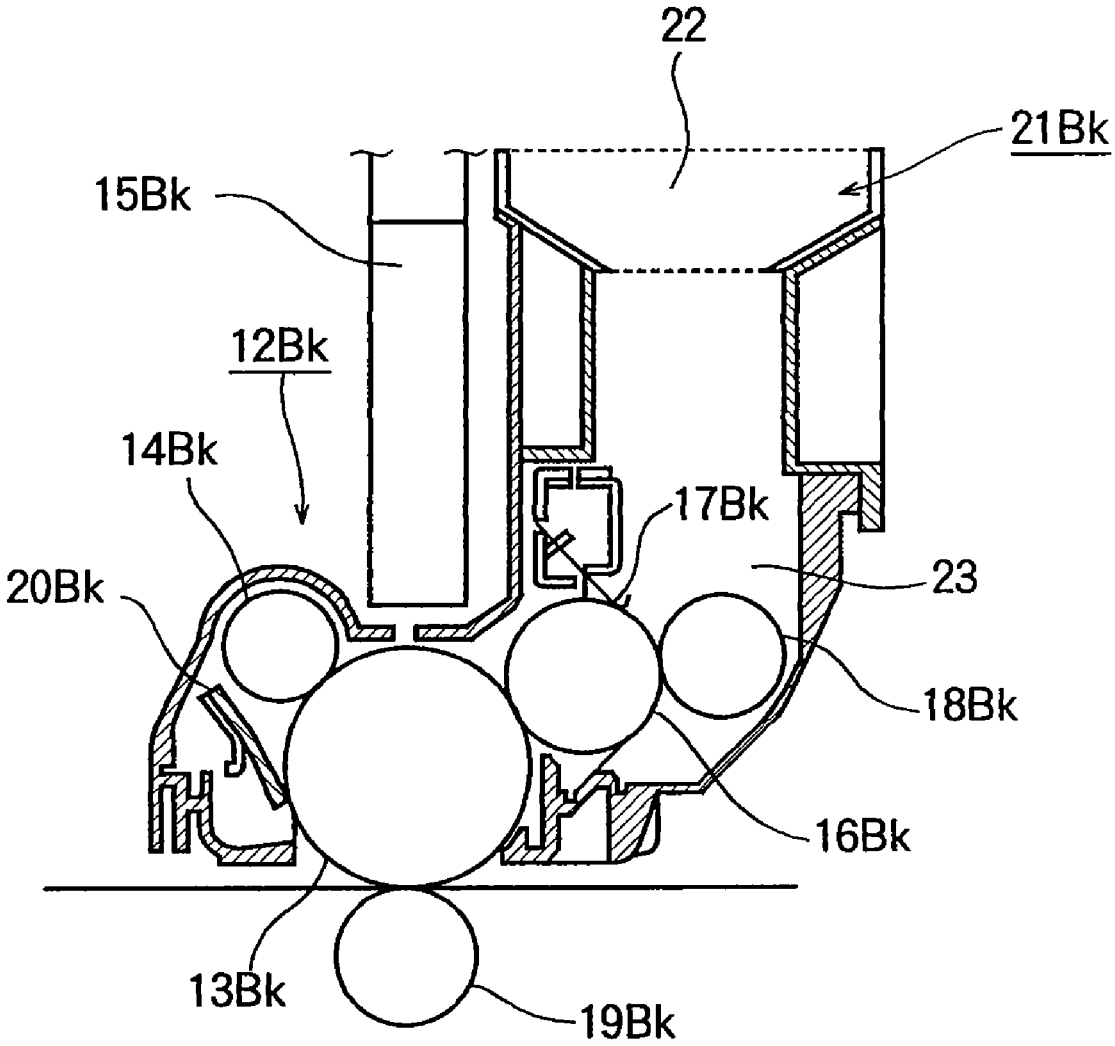
FIG. 2 is a sectional view of a main part of the printer according to the first embodiment of the present invention.

FIG. 1 is a schematic view of a printer according to the first embodiment of the present invention. FIG. 2 is a sectional view of a main part of the printer according to the first embodiment of the present invention.

As shown in FIG. 1, a printer 11 includes image forming units 12Bk, 12Y, 12M and 12C (i.e., a plurality of image forming portions). The image forming units 12Bk, 12Y, 12M and 12C are arranged in this order from the upstream side to the downstream side in the feeding direction of a sheet (i.e., a recording medium) 25. The image forming units 12Bk, 12Y, 12M and 12C are configured as LED printing units, and form toner images (i.e., developer images) of black, yellow, magenta and cyan.

The image forming units 12Bk, 12Y, 12M and 12C include photosensitive drums 13Bk, 13Y, 13M and 13C as image bearing bodies. The image forming units 12Bk, 12Y, 12M and 12C further include charging rollers (i.e., charging devices) 14Bk, 14Y, 14M and 14C provided in opposition to the photosensitive drums 13Bk, 13Y, 13M and 13C for charging the surfaces of the photosensitive drums 13Bk, 13Y, 13M and 13C uniformly and evenly. The image forming units 12Bk, 12Y, 12M and 12C further include developing rollers (i.e., developer bearing bodies) 16Bk, 16Y, 16M and 16C provided in contact with the photosensitive drums 13Bk, 13Y, 13M and 13C. The developing rollers 16Bk, 16Y, 16M and 16C bear the toner (i.e., the developer) and cause the toner to adhere to the surfaces of the photosensitive drums 13Bk, 13Y, 13M and 13C in accordance with the rotation of the developing rollers 16Bk, 16Y, 16M and 16C. The image forming units 12Bk, 12Y, 12M and 12C further include sponge rollers (i.e., developer supplying members) 18Bk, 18Y, 18M and 18C provided in contact with the developing rollers 16Bk, 16Y, 16M and 16C for supplying the toner to the developing rollers 16Bk, 16Y, 16M and 16C. The image forming units 12Bk, 12Y, 12M and 12C further include developing blades (i.e., thin-layer forming members) 17Bk, 17Y, 17M and 17C having tips pressed against the photosensitive drums 13Bk, 13Y, 13M and 13C. The developing blades 17Bk, 17Y, 17M and 17C form thin layers of the toner supplied to the photosensitive drums 13Bk, 13Y, 13M and 13C. The image forming units 12Bk, 12Y, 12M and 12C further include cleaning blades 20Bk, 20Y, 20M and 20C (i.e., cleaning devices) or the like. The cleaning blades 20Bk, 20Y, 20M and 20C remove the residual toner remaining on the photosensitive drums 13Bk, 13Y, 13M and 13C after the transferring. The developing rollers 16Bk, 16Y, 16M and 16C, the sponge rollers 18Bk, 18Y, 18M and 18C and the developing blades 17Bk, 17Y, 17M and 17C constitute a developing device.

LED heads (i.e., exposing devices) 15Bk, 15Y, 15M and 15C are respectively provided in opposition to the image forming units 12Bk, 12Y, 12M and 12C for exposing the surfaces of the photosensitive drums 13Bk, 13Y, 13M and 13C to thereby form latent images. Transfer rollers (i.e., transfer members) 19Bk, 19Y, 19M and 19C are respectively provided in opposition to the image forming units 12Bk, 12Y, 12M and 12C for transferring the toner images of the respective colors formed on the photosensitive drums 12Bk, 12Y, 12M and 12C to the sheet 25, to thereby form color toner image on the sheet 25.

The image forming units 12Bk, 12Y, 12M and 12C respectively have main bodies and developer cartridges (i.e., cassettes) 21Bk, 21Y, 21M and 21C detachably mounted to the main bodies of the image forming units.

A sheet cassette (i.e., a medium storing portion) 24 is provided on the lower part of a main body of the printer 11, and stores the sheets 25. A fixing device (i.e., a fuser) includes a heat roller (i.e., a first roller) 29 and a backup roller (i.e., a second roller) 30 that fix the color toner image to the sheet 25.

In the above configured printer 11, the sheet 25 is fed from the sheet cassette 24 by means of a sheet feeding mechanism (not shown) and carried by means of a carrying mechanism (not shown) in a direction shown by an arrow in FIG. 1. The sheet 25 proceeds through between the image forming units 12Bk, 12Y, 12M and 12C and the transfer rollers 19Bk, 19Y, 19M and 19C so that the toner images of the respective colors are transferred to the sheet 25 in series. As a result, the color toner image is formed on the sheet 25.

Then, the sheet 25 on which the color toner image is transferred is carried to the fixing device 28. In the fixing device 28, the color toner image is fixed to the sheet 25, with the result that the color image is formed on the sheet 25. Then, the sheet 25 is ejected by eject rollers (not shown) to the exterior of the main body of the printer 11.

Next, the image forming units 12Bk, 12Y, 12M and 12C and the developer cartridges 21Bk, 21Y, 21M and 21C will be described.

The image forming units 12Bk, 12Y, 12M and 12C have the same configurations, and the developer cartridges 21Bk, 21Y, 21M and 21C have the same configurations. Therefore, the image forming unit 12Bk and the developer cartridge 21Bk will be described, and the description of the image forming units 12Y, 12M and 12C and the developer cartridges 21Y, 21M and 21C are omitted.

Figure 3A:
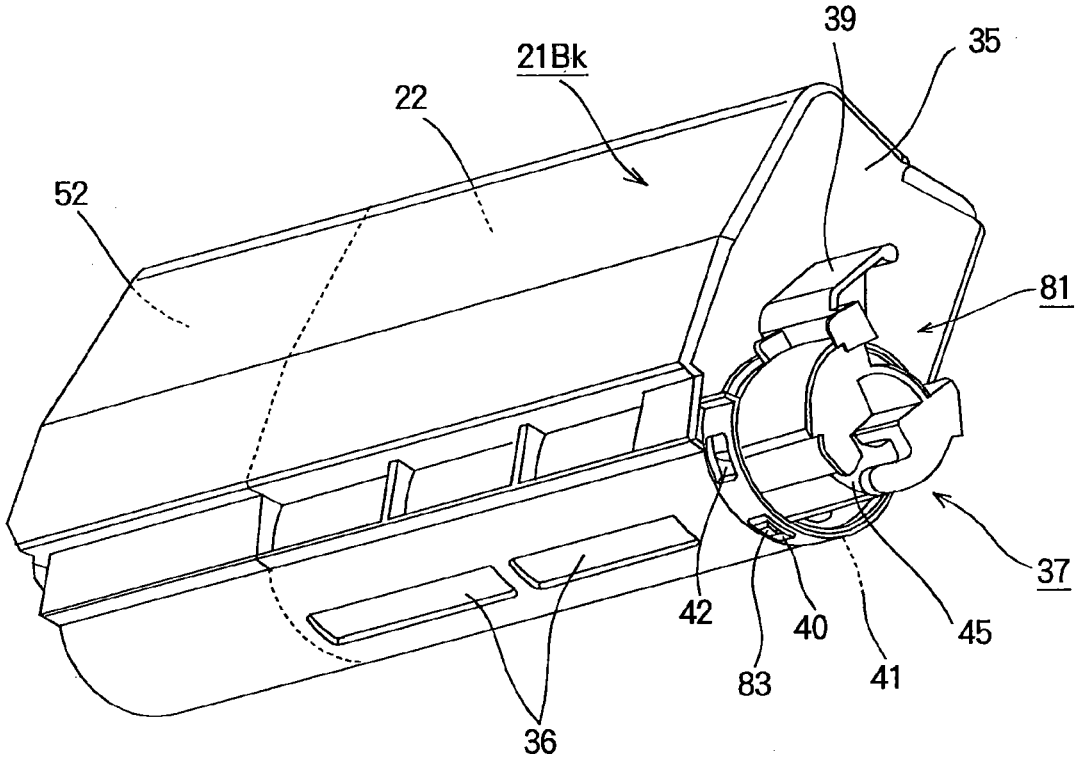
FIG. 3A is a perspective view of a developer cartridge according to the first embodiment of the present invention.

As shown in FIG. 3A, the developer cartridge 21Bk includes a toner storing chamber (i.e., a developer storing portion or a storing portion) 22 that stores the toner. The toner stored in the toner storing chamber 22 is supplied to a toner hopper 23 of the image forming unit 12Bk by operating an operating portion (not shown in FIG. 3A).

The toner supplied to the toner hopper 23 is further supplied to the developing roller 16Bk via the sponge roller 18Bk. The developing blade 17Bk scrapes excess toner on the developing roller 16Bk, and a thin layer is formed on the developing roller 16Bk. The thin layer of the toner is transferred to the photosensitive drum 13Bk by the rotation of the developing roller 16Bk.

The surface of the photosensitive drum 13Bk is uniformly and evenly charged by the charging roller 14Bk. The surface of the photosensitive drum 13Bk is then exposed to the light by the LED head 15Bk in accordance with the image data, so that the latent image is formed on the photosensitive drum 13Bk. Then, the developing roller 16Bk develops the latent image with toner that adheres to the latent image, and the toner image is formed on the photosensitive drum 13Bk.

Then, the toner image is transferred to the sheet 25 by the transfer roller 19Bk. The residual toner that remains on the photosensitive drum 13Bk is scraped off and removed by the cleaning blade 20Bk.

Next, the developer cartridge (i.e., the cassette) 21Bk will be described in detail.

Figure 3B:
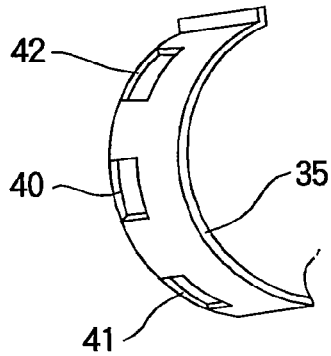
FIG. 3B is a partially enlarged view of FIG. 3A.
Figure 4:
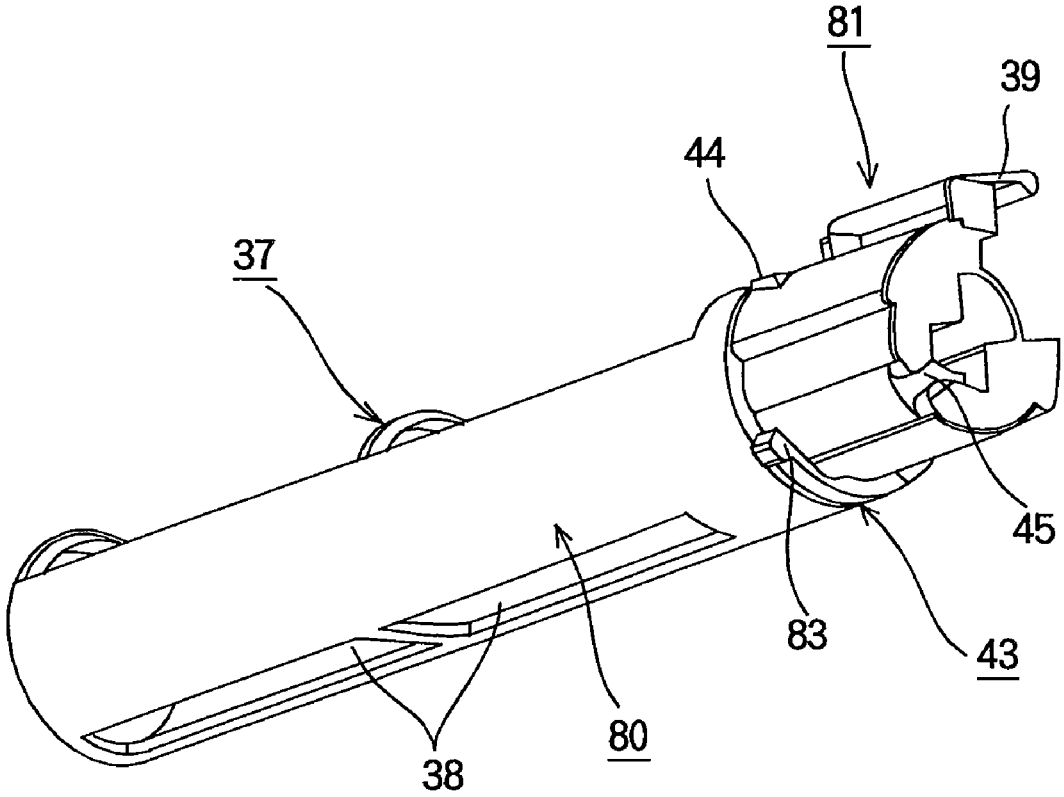
FIG. 4 is a perspective view of an inner barrel member according to the first embodiment of the present invention.

FIG. 3A is a perspective view of the developer cartridge of the first embodiment of the present invention. FIG. 3B is a partially enlarged view of FIG. 3A. FIG. 4 is a perspective view of an inner barrel member of the first embodiment of the present invention.

In FIGS. 3A and 4, the developer cartridge 21Bk includes an outer barrel member 35 and an inner barrel member 37. The outer barrel member (i.e., a cassette main body) 35 includes the toner storing chamber 22 and a waste toner storing chamber (i.e., a waste developer storing portion) 52. The waste toner storing chamber 52 stores the waste toner recovered by the cleaning blade 20Bk. The toner storing chamber 22 and the waste toner storing chamber 52 are divided by a partition plate (i.e., a partition member) indicated by a dashed line in FIG. 3A. A toner supply opening (i.e., a first developer supplying portion) 36 is formed on the bottom of the outer barrel member 35 for supplying the toner in the toner storing chamber 22 to the main body of the image forming unit. As shown in FIG. 3B, cutout portions (i.e., to-be-locked portions) 40, 41 and 42 are formed on the circumference of the outer barrel member 35 for locking the rotation of the inner barrel member 37.

The inner barrel member 37 has a main part inserted into the toner storing chamber 22, and functions as a shutter mechanism (opening-and-closing member) for closing and opening the toner supply opening 36. In this regard, as shown in FIG. 4, the inner barrel member 37 has a cylindrical portion 80, an operating portion 39 for operating and rotating the cylindrical portion 80, an engaging portion 81 for detachably mounting the developer cartridge 21Bk to a main body 85 (FIG. 5) of the image forming unit 12Bk (FIG. 5), and lock portions 43 and 44 formed by projections engaging the cutout portions 40, 41 and 42 to regulate the rotation of the inner barrel member 37. The operating portion 39 is integrally formed with the engaging portion 81. An opening 38 (i.e., a second developer supplying portion) is formed on the bottom of the cylindrical portion 80 corresponding to the toner supply opening 36 (FIG. 3A). The cylindrical portion 80 functions as an opening-and-closing member. With the rotation of the cylindrical portion 80, the cylindrical portion 80 takes an opening position where the cylindrical portion 80 opens the toner supply opening 36, and a closing position where the cylindrical portion 80 closes the toner supply opening 36.

The lock portions 43 and 44 are resiliently deformable and have projections 83 at the tips thereof. By pushing the projections 83 of the lock portions 43 and 44 inwardly in the radial direction, the lock portions 43 and 44 are deformed inwardly, and the engagement between the cutout portions 40 through 42 and the lock portions 43 and 44 are released. As a result, the inner barrel member 37 becomes rotatable. Further, an opening groove 45 is formed on a predetermined position in circumferential direction of the operating portion 39, and the opening groove 45 extends in the radial direction as a guide portion.

Next, an operation for mounting the developer cartridge 21Bk to the image forming unit 12Bk will be described.

Figure 5:
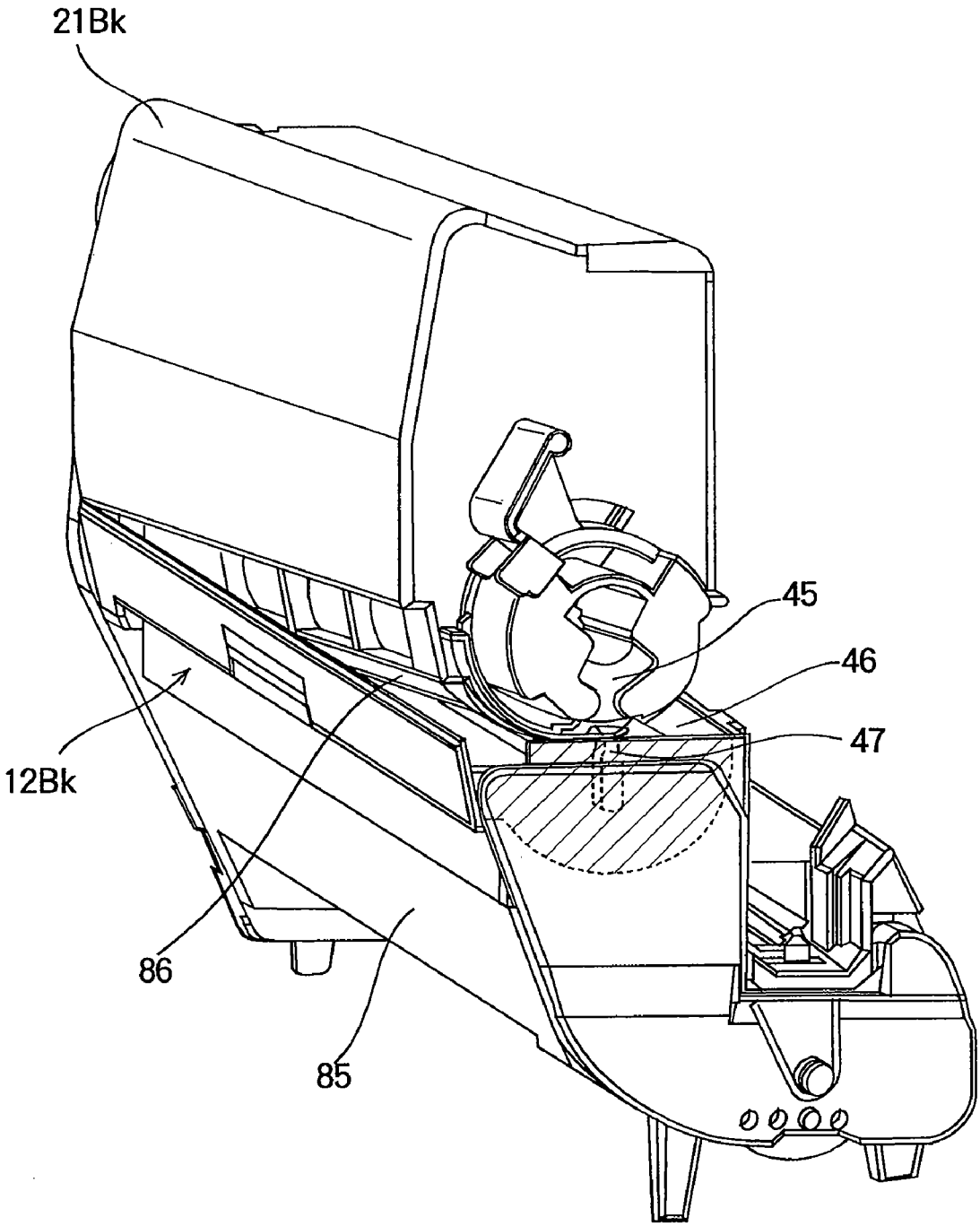
FIG. 5 is a perspective view of an image forming unit and the developer cartridge according to the first embodiment of the present invention.

FIG. 5 is a perspective view of the image forming unit and the developer cartridge according to the first embodiment of the present invention.

In FIG. 5, the image forming unit 12Bk includes the main body 85 and the developer cartridge 21Bk. A lower semicylindrical part 86 of the developer cartridge 21Bk is mounted to an upper end of the main body 85 of the image forming unit 12Bk. A cartridge mounting portion 46 is formed on the upper end of the main body 85, and supports the developer cartridge 21Bk. The cartridge mounting portion 46 has a rib 47 (i.e., a to-be-engaged portion) in the form of a rod extending in a vertical direction. The rib 47 is inserted into the opening groove 45 when the developer cartridge 21Bk is mounted to the main body 85 of the image forming unit 12Bk.

With such an arrangement, the developer cartridge 21Bk can be mounted to the cartridge mounting portion 46, by inserting the rib 47 into the opening groove 45.

Figure 6:
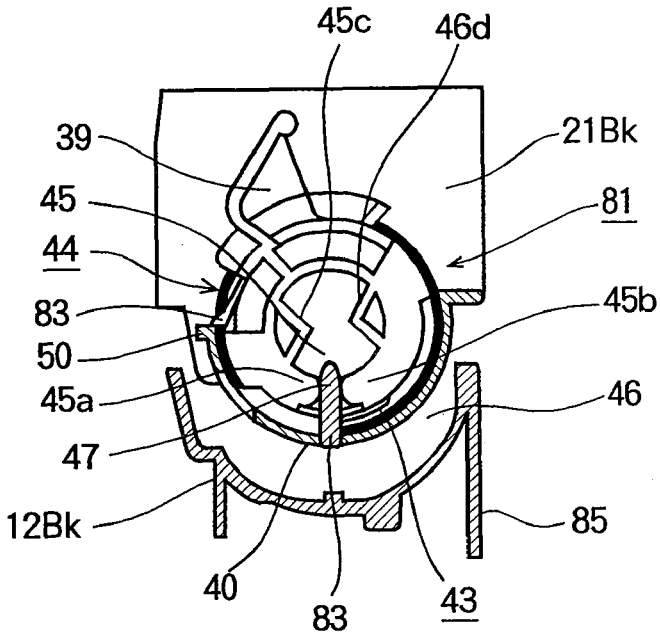
FIG. 6 is a first view illustrating the operation for mounting the developer cartridge to the image forming unit according to the first embodiment of the present invention.
Figure 7:
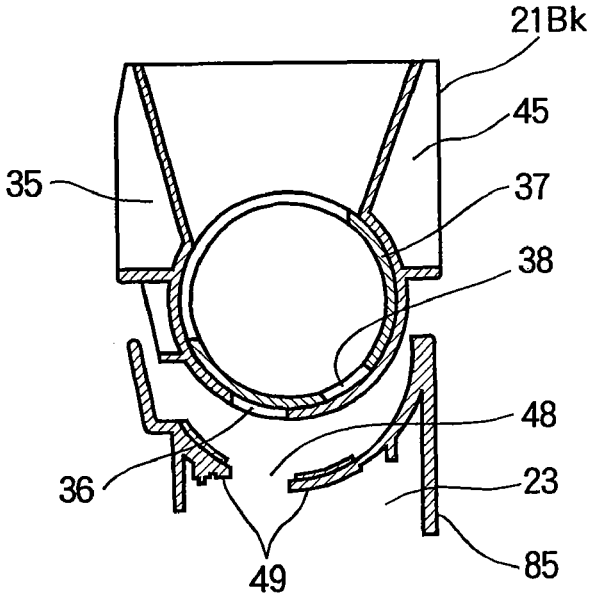
FIG. 7 is a first sectional view illustrating the state of a toner supplying opening according to the first embodiment of the present invention.
Figure 8:
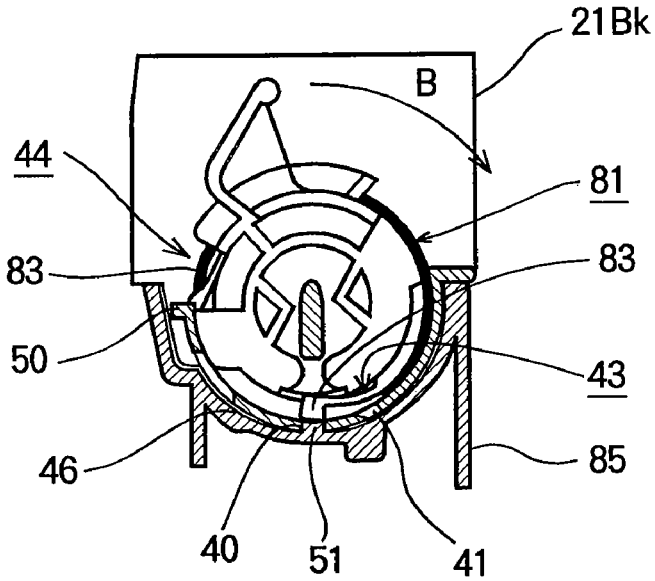
FIG. 8 is a second view illustrating the operation for mounting the developer cartridge to the image forming unit according to the first embodiment of the present invention.
Figure 9:
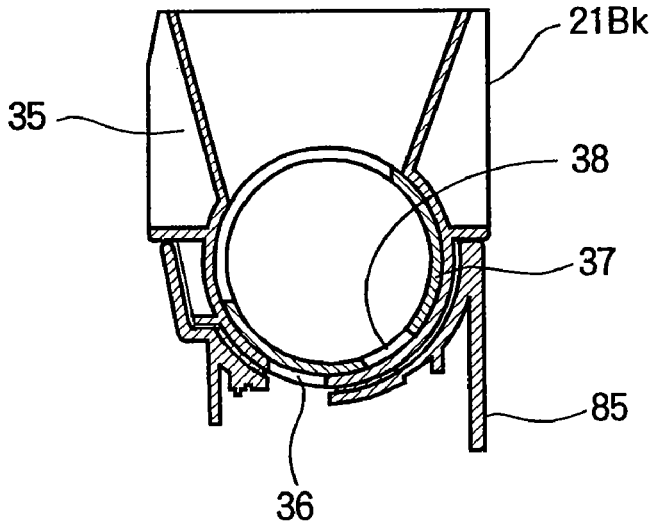
FIG. 9 is a second sectional view illustrating the state of the toner supplying opening according to the first embodiment of the present invention.
Figure 10:
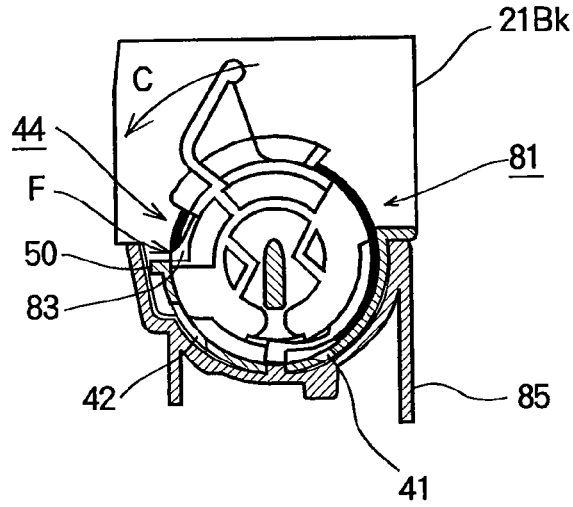
FIG. 10 is a third view illustrating the operation for mounting the developer cartridge to the image forming unit according to the first embodiment of the present invention.
Figure 11:
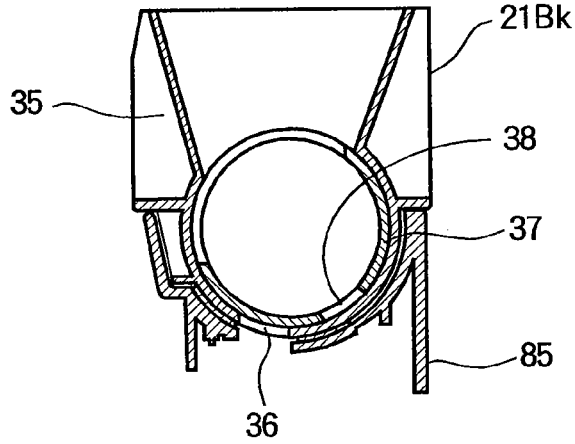
FIG. 11 is a third sectional view illustrating the state of the toner supplying opening according to the first embodiment of the present invention.
Figure 12:
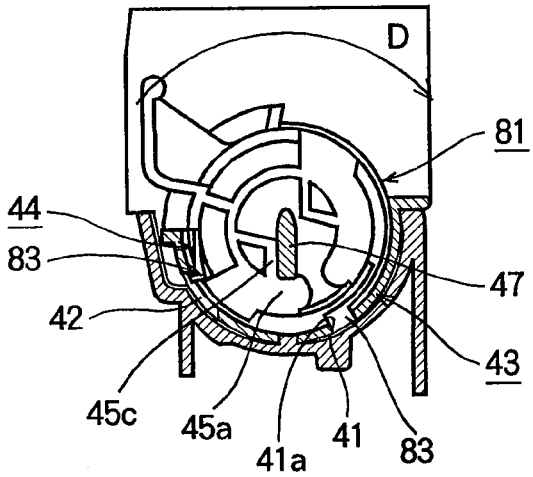
FIG. 12 is a fourth view illustrating the operation for mounting the developer cartridge to the image forming unit according to the first embodiment of the present invention.
Figure 13:
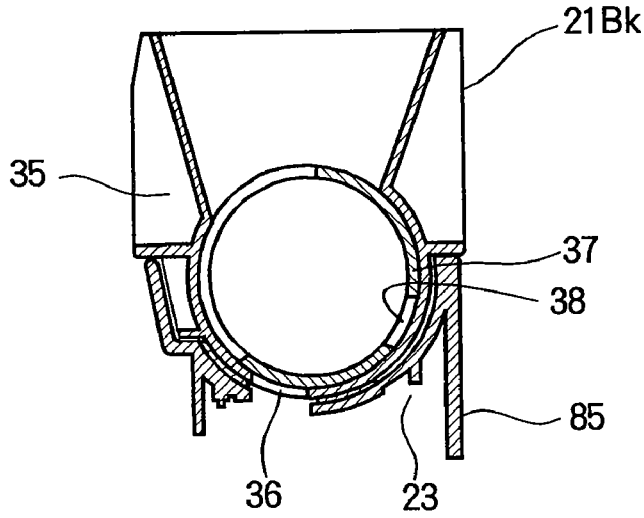
FIG. 13 is a fourth sectional view illustrating the state of the toner supplying opening according to the first embodiment of the present invention.
Figure 14:
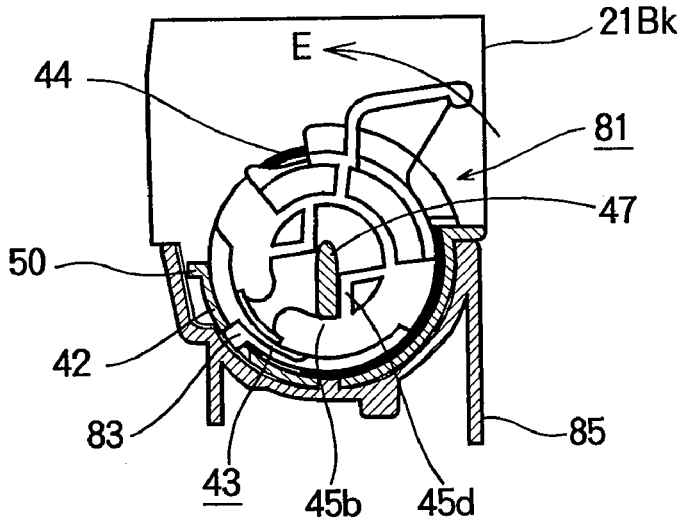
FIG. 14 is a fifth view illustrating the operation for mounting the developer cartridge to the image forming unit according to the first embodiment of the present invention.
Figure 15:
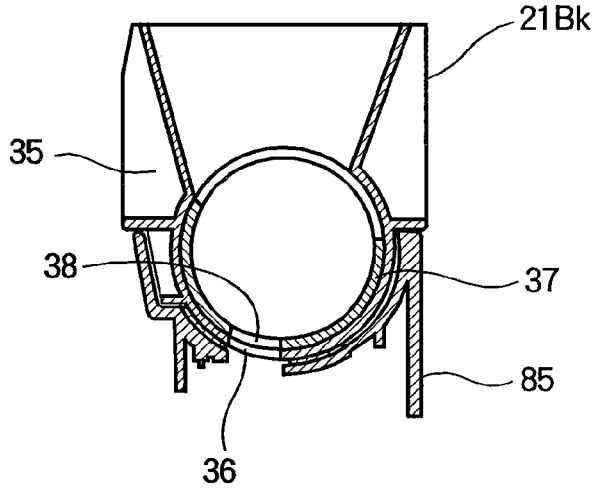
FIG. 15 is a fifth sectional view illustrating the state of the toner supplying opening according to the first embodiment of the present invention.

FIG. 6 is a first view illustrating the operation for mounting the developer cartridge to the image forming unit according to the first embodiment of the present invention. FIG. 7 is a first sectional view illustrating the state of the toner supplying opening according to the first embodiment of the present invention. FIG. 8 is a second view illustrating the operation for mounting the developer cartridge to the image forming unit according to the first embodiment of the present invention. FIG. 9 is a second sectional view illustrating the state of the toner supplying opening according to the first embodiment of the present invention. FIG. 10 is a third view illustrating the operation for mounting the developer cartridge to the image forming unit according to the first embodiment of the present invention. FIG. 11 is a third sectional view illustrating the state of the toner supplying opening according to the first embodiment of the present invention. FIG. 12 is a fourth view illustrating the operation for mounting the developer cartridge to the image forming unit according to the first embodiment of the present invention. FIG. 13 is a fourth sectional view illustrating the state of the toner supplying opening according to the first embodiment of the present invention. FIG. 14 is a fifth view illustrating the operation for mounting the developer cartridge to the image forming unit according to the first embodiment of the present invention. FIG. 15 is a fifth sectional view illustrating the state of the toner supplying opening according to the first embodiment of the present invention.

The above described FIGS. 6, 8, 10, 12 and 14 show the state of the vicinity of the engaging portion 81 when the operating portion 39 is operated. The above described FIGS. 7, 9, 11, 13 and 15 show the relationship between the developer cartridge 21Bk and the main body 85 of the image forming unit 12Bk when the operating portion 39 is operated. In FIGS. 6, 8 and 10, the engaging portion 81 does not engage the rib 47, and the toner supplying opening 36 is in the closing position. In FIG. 12, the engaging portion 81 engages the rib 47, and the toner supplying opening 36 is in the closing position. In FIG. 14, the engaging portion 81 engages the rib 47, and the toner supplying opening 36 is in the opening position.

As shown in FIG. 7, the cartridge mounting portion 46 has a toner receiving opening (i.e., a developer receiving portion) 48 formed at a position corresponding to the toner supplying opening 36. The toner is supplied to the toner hopper 23 via the toner supplying opening 36 and the toner receiving opening 48. A resilient seal member (i.e., a seal member with resiliency) 49, made of a sponge composed of urethane foam, is attached to a portion around the toner receiving opening 48 of the cartridge mounting portion 46. The developer cartridge 21Bk is mounted to the image forming unit 12Bk so that the resilient seal member 49 is compressed by a certain amount. Further, arcuate-shaped sidewall ribs (i.e., regulating members) 45*a* and 45*b* are formed on both sides with respect to the opening groove 45. Bent-shaped sidewall ribs 45*c* and 45*d* protrude inwardly from the inner surface of the sidewall ribs 45*a* and 45*b*.

When the developer cartridge 21Bk is not mounted to the cartridge mounting portion 46, the projection 83 of the lock portion 43 engages the cutout portion 40 as shown in FIG. 6. Therefore, the inner barrel member 37 does not rotate with respect to the outer barrel member 35 in the direction shown by an arrow B in FIG. 8. Further, a rotation stopper rib 50 formed on the outer barrel member 35 abuts against the projection 83 of the lock portion 44, and therefore the inner barrel member 37 does not rotate with respect to the outer barrel member 35 in the direction shown by an arrow C in FIG. 10.

In this state, as shown in FIG. 7, the opening 38 and the toner supplying opening 36 are not aligned to each other, and therefore the toner supplying opening 36 is closed.

When the developer cartridge 21Bk is mounted to the image forming unit 12Bk, the rib 47 is inserted into the opening groove 45, and the developer cartridge 21Bk abuts against the main body 85 of the image forming unit 12Bk.

In this state, as shown in FIG. 8, the lock portion 43 is pressed by a projection 51 formed on the cartridge mounting portion 46 and is deformed inwardly. Therefore, the engagement between the projection 83 of the lock portion 43 and the cutout portion 40 is released, with the result that the inner barrel member 37 becomes rotatable with respect to the outer barrel member 35 in the direction shown by the arrow B. The position of the operating portion 39 shown in FIG. 8 is referred to as "a third position". In this state, when the operating portion 39 is rotated in the direction shown by the arrow B, the engaging portion 81 reaches the state shown in FIG. 14, and the rib 47 abuts against the sidewall rib 45*d*. Therefore, further rotation of the inner barrel member 37 is prevented.

In the state shown in FIG. 8, the rotation stopper rib 50 abuts against the projection of the lock portion 44, and therefore the inner barrel member 37 can not rotate with respect to the outer barrel member 35 in the direction shown by the arrow C. However, if the lock portion 44 is pushed in the direction shown by an arrow F as shown in FIG. 10 using a tool or the like, the lock portion 44 is deformed inwardly so that the projection 83 moves inside the rotation stopper rib 50. In this state, the inner barrel member 37 becomes rotatable with respect to the outer barrel member 35 in the direction shown by the arrow C.

Further, when the inner barrel member 37 is rotated with respect to the outer barrel member 35 in the direction shown by the arrow C in FIG. 10, the rib 47 abuts against the sidewall rib 45*c* as shown in FIG. 12, and therefore further rotation of the inner barrel member 37 is prevented.

In the state shown in FIG. 12, the projection 83 of the lock portion 43 engages the cutout portion 41, and the projection 83 of the lock portion 44 engages the cutout portion 42. Further, as shown in FIG. 13, the opening 38 and the toner supplying opening 36 are not aligned to each other, and therefore the toner supplying opening 36 is kept closed. Therefore, the developer cartridge 21Bk can be mounted to the main body 85 of the image forming unit 12Bk in such a manner that the supplying opening 36 is closed. In this case, since the projection 83 of the lock portion 43 engages the cutout portion 41 and the projection 83 of the lock portion 44 engages the cutout portion 42, the lock portions 43 and 44 are released from resilient deformation, and therefore the creep deformation of the lock portions 43 and 44 does not occur. The position of the operating portion 39 shown in FIG. 12 is referred to as "a second position".

Then, when the operating portion 39 is rotated in the direction shown by an arrow D shown FIG. 12, the projection 83 moves out of the cutout portion 41 (via a tapered end 41*a* of the cutout portion 41) and does not prevent the rotation of the inner barrel member 37 in the direction shown by the arrow D. As a result, the engaging portion 81 reaches the state shown in FIG. 14, and the rib 47 abuts against the sidewall rib 45*c* so that further rotation of the inner barrel member 37 is prevented.

As shown in FIG. 15, the opening 38 and the toner supplying opening 36 are aligned to each other, and therefore the toner supplying opening 36 is opened.

Accordingly, the supplying opening 36 can be opened in a state where the developer cartridge 21Bk is mounted to the main body 85 of the image forming unit 12Bk. In this case, since the projection 83 of the lock portion 43 engages the cutout portion 42, the lock portion 43 is released from resilient deformation, and therefore the creep deformation of the lock portion 43 does not occur. The position of the operating portion 39 shown in FIG. 14 is referred to as "a first position".

In this regard, when the operating portion 39 is rotated in the direction shown by an arrow E in FIG. 14, the engaging portion 81 reaches the state shown in FIG. 8.

Since the image forming unit 12Bk is configured as above, the developer cartridge 21Bk can be mounted to the main body 85 of the image forming unit 12Bk by operating the operating portion 39 in the order of steps shown in FIGS. 6, 8, 10 and 12, and the image forming unit 12Bk can be shipped in a state shown in FIG. 12.

Then, when the user starts using the image forming unit 12Bk, the user operates the operating portion 39 (from the state shown in FIG. 12) in the order of steps shown in FIGS. 8 and 14. With such an operation, the toner supply opening 36 can be opened in a state where the developer cartridge 21Bk is mounted to the main body 85 of the image forming unit 12Bk.

Furthermore, when the user replaces the developer cartridge 21Bk, the user operates the operating portion 39 (from the state shown in FIG. 14) in the order of steps shown in FIGS. 8 and 6 to thereby close the toner supplying opening 36 and remove the old (used) developer cartridge 21Bk from the main body 85 of the image forming unit 12Bk. Then, the user mounts new developer cartridge 21Bk to the main body 85 of the image forming unit 12Bk as shown in FIG. 6, and operates the operating portion 39 (from the state shown in FIG. 6) in the order of steps shown in FIGS. 8 and 14 to open the toner supplying opening 36.

In this replacing operation, the user does not need to perform the operation of the steps shown in FIGS. 8, 10 and 12, and therefore the user can replace the developer cartridge 21Bk in a similar manner to the conventional replacing operation of the developer cartridge.

As described above, in the manufacturing process of the first embodiment, the developer cartridges 21Bk, 21Y, 21M and 21C can be mounted to the main bodies 85 of the image forming units 12Bk, 12Y, 12M and 12C in such a manner that the toner supplying openings 36 are closed. In this state, the image forming units 12Bk, 12Y, 12Y and 12C (to which the developer cartridges 21Bk, 21Y, 21M and 21C are mounted) can be packed and shipped. Furthermore, the printer 11 can be packed and shipped in such a manner that the image forming units 12Bk, 12Y, 12M and 12C are mounted to the main body of the printer 11.

Accordingly, the costs for the image forming units 12Bk, 12Y, 12M and 12C and the printer 11 can be reduced. Moreover, the image forming units 12Bk, 12Y, 12M and 12C can be transported in a state where the developer cartridges 21Bk, 21Y, 21M and 21C are mounted to the main body 85 of the image forming units 12Bk, 12Y, 12M and 12C, and therefore it becomes possible to prevent the toner from leaking outside through the joint portions between the bodies 85 and the developer cartridges 21Bk, 21Y, 21M and 21C during transport.

Moreover, the toner supplying openings 36 and the toner receiving openings 48 are sealed by the resilient seal member 49, and therefore it becomes possible to effectively prevent the toner from leaking outside through the joint portions between the bodies 85 and the developer cartridges 21Bk, 21Y, 21M and 21C during transport.

Second Embodiment

Next, the second embodiment of the present invention will be described. Components having the same structures as those of the first embodiment are assigned the same reference numerals, and the duplicate explanation is omitted. With regard to the advantages obtained by the same structures as those of the first embodiment, the description of the advantages in the first embodiment is incorporated herewith.

Figure 16:
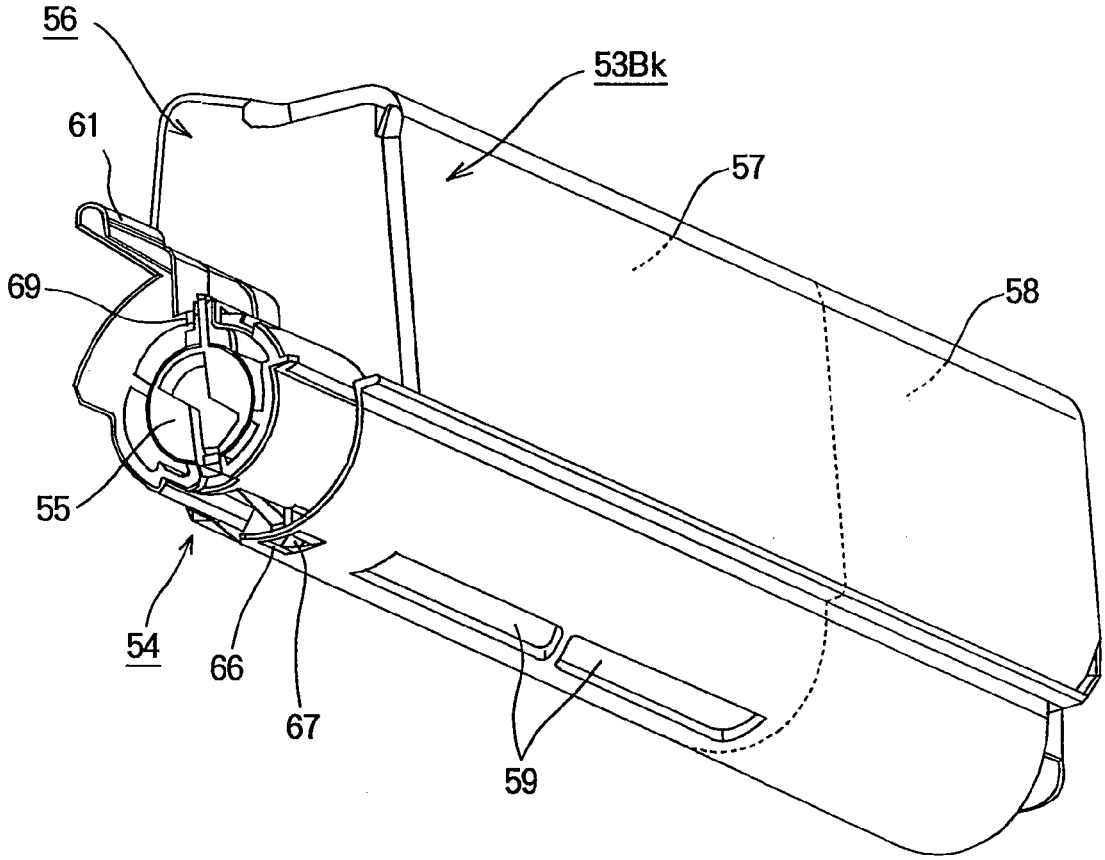
FIG. 16 is a perspective view of a developer cartridge according to the second embodiment of the present invention.
Figure 17:
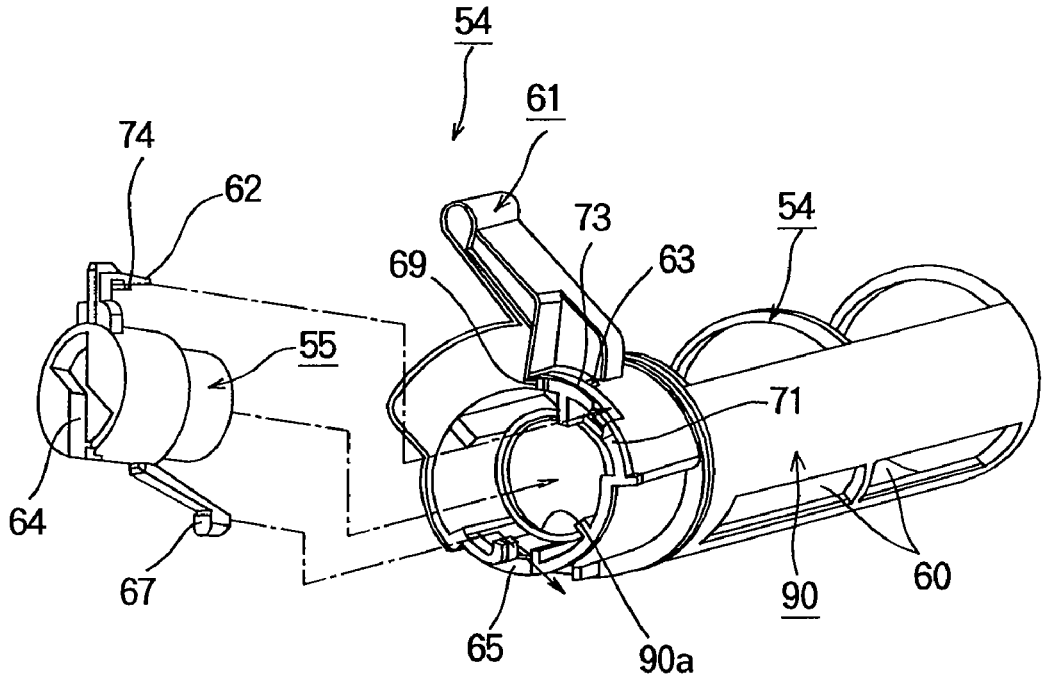
FIG. 17 is an exploded perspective view of an inner barrel member according to the second embodiment of the present invention.

FIG. 16 is a perspective view of the developer cartridge of the second embodiment of the present invention. FIG. 17 is an exploded perspective view of an inner barrel member of the second embodiment of the present invention.

In FIG. 16, a developer cartridge 53Bk includes an outer barrel member (i.e., a cassette main body) 56 and an inner barrel member (i.e., an opening-and-closing member) 54. An engaging member (i.e., an engaging portion) 55 is formed on an end of the inner barrel member 54. The outer barrel member 56 includes a toner storing chamber (i.e., a developer storing portion or a storing portion) 57 and a waste toner storing chamber 58. The toner storing chamber 57 and the waste toner storing chamber 58 are divided by a partition wall shown by a dashed line in FIG. 16. A toner supplying opening (i.e., a first developer supplying portion) 59 is formed on the bottom of the outer barrel member 56 for supplying the toner in the toner storing chamber 57 to the main body 85 of the image forming unit 12Bk.

The inner barrel member 54 has a main part inserted in the toner storing chamber 57, and functions as a shutter for opening and closing the toner supplying opening 59. As shown in FIG. 17, the inner barrel member 54 includes a cylindrical portion 90, an operating portion 61 for operating and rotating the cylindrical portion 90, and an engaging member (i.e., an engaging portion) 55 for engaging and disengaging the developer cartridge 53Bk and the main body 85 of the image forming unit 12Bk. The operating portion 61 and the engaging member 55 are formed as individual members (i.e., not integrally formed with each other). An opening 60 (i.e., a second developer supplying portion) is formed on the bottom of the cylindrical portion 90 corresponding to the toner supply opening 59.

Further, a cylindrical receiving hole 90*a* is formed on the cylindrical portion 90 adjacent to the operating portion 61. The engaging member 55 is inserted in the receiving hole 90*a* so that the engaging member 55 is rotatable in the receiving hole 90*a*. The operating portion 61 has an opening groove guide 65 formed on a position corresponding to an opening groove 64 formed on the engaging member 55.

The engaging member 55 includes a lock portion 62 that engages a projection 63 of the operating portion 61 to regulate the rotation of the engaging member 55 with respect to the inner barrel member 54. The engaging member 55 further includes a retaining rib (i.e., a second retaining element) 74 that engages a retaining rib (i.e., a first retaining element) 73 formed on the operating portion 61 to prevent the dropping of the engaging member 55 from the inner barrel member 54. The engaging member 55 further includes a lock portion 67 that engages a cutout portion 66 (FIG. 16) formed on the circumference of the outer barrel member 56 to regulate the rotation of the inner barrel member 54 with respect to the outer barrel member 56.

The lock portions 62 and 67 are resiliently deformable. By releasing the engagement between the lock portion 67 and the cutout portion 66, the inner barrel member 54 becomes rotatable with respect to the outer barrel member 56. Further, by releasing the engagement between the lock portion 67 and the cutout portion 66, and by releasing the engagement between the lock portion 62 and the projection 63, the engaging member 55 becomes rotatable with respective to the cylindrical member 54. In FIG. 17, a rotation stopper rib 71 is provided for regulating the rotation of the engaging portion 55.

Next, an operation for mounting the developer cartridge 53Bk to the image forming unit 12Bk will be described.

Figure 18:
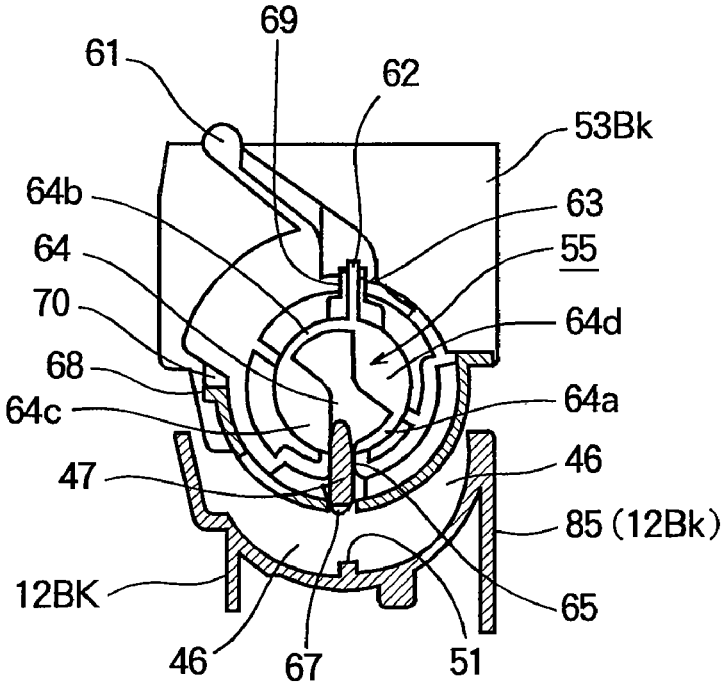
FIG. 18 is a first view illustrating the operation for mounting the developer cartridge to the image forming unit according to the second embodiment of the present invention.
Figure 19:
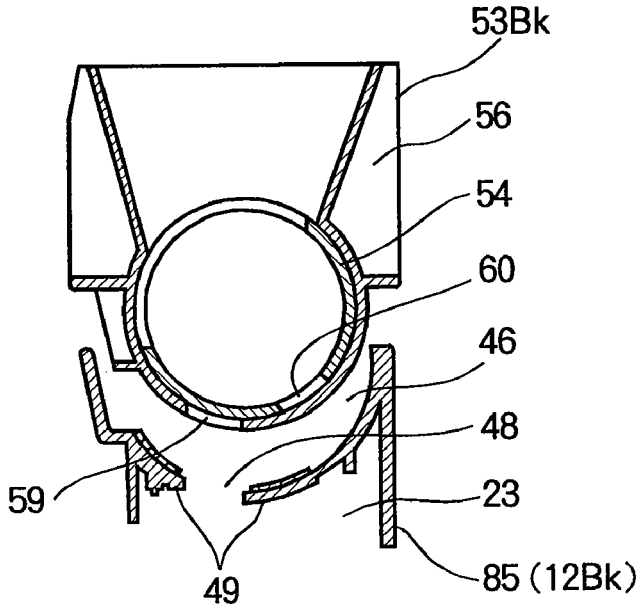
FIG. 19 is a first sectional view illustrating the state of a toner supplying opening according to the second embodiment of the present invention.
Figure 20:
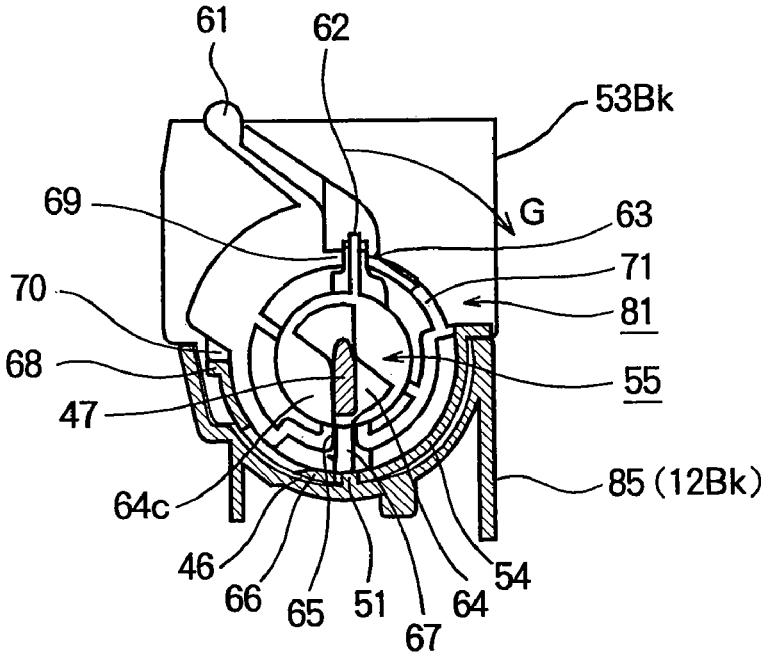
FIG. 20 is a second view illustrating the operation for mounting the developer cartridge to the image forming unit according to the second embodiment of the present invention.
Figure 21:
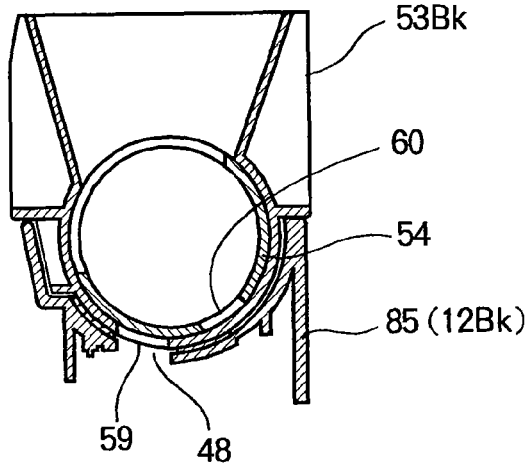
FIG. 21 is a second sectional view illustrating the state of the toner supplying opening according to the second embodiment of the present invention.
Figure 22:
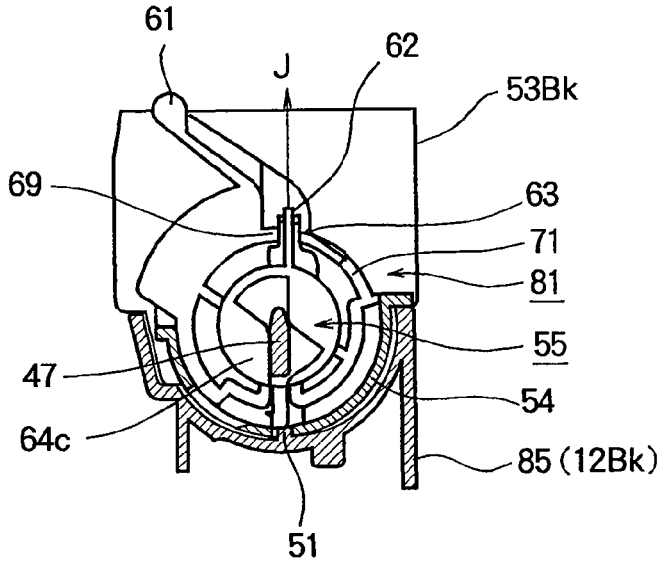
FIG. 22 is a third view illustrating the operation for mounting the developer cartridge to the image forming unit according to the second embodiment of the present invention.
Figure 23:
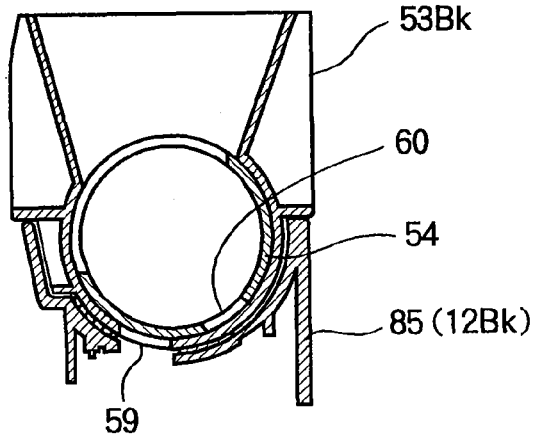
FIG. 23 is a third sectional view illustrating the state of the toner supplying opening according to the second embodiment of the present invention.
Figure 24:
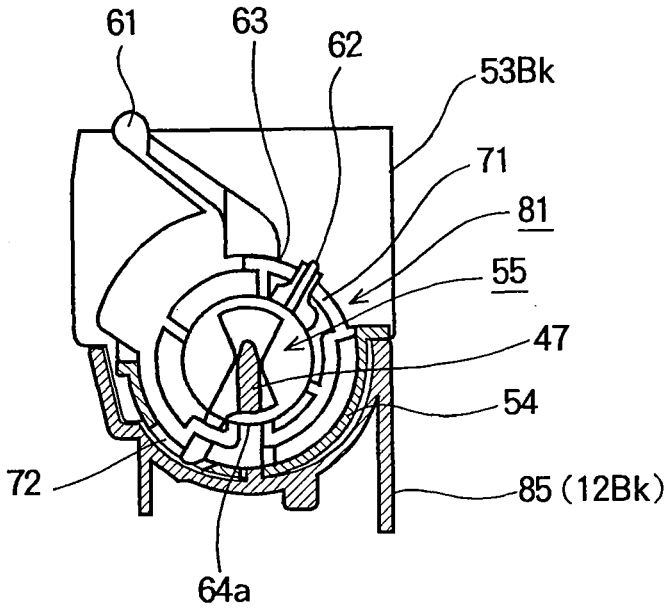
FIG. 24 is a fourth view illustrating the operation for mounting the developer cartridge to the image forming unit according to the second embodiment of the present invention.
Figure 25:
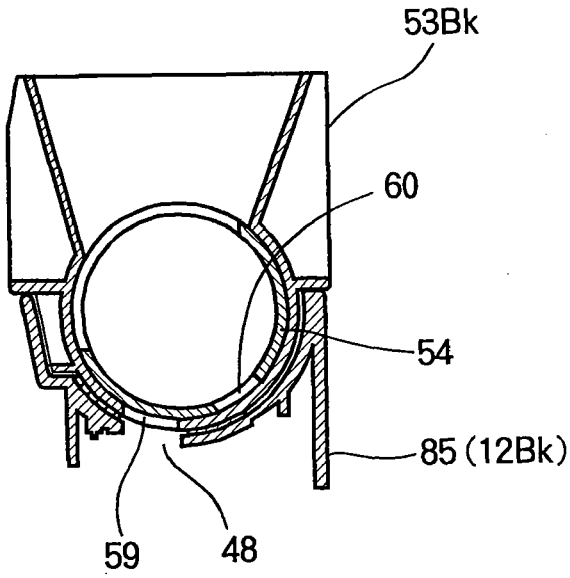
FIG. 25 is a fourth sectional view illustrating the state of the toner supplying opening according to the second embodiment of the present invention.
Figure 26:
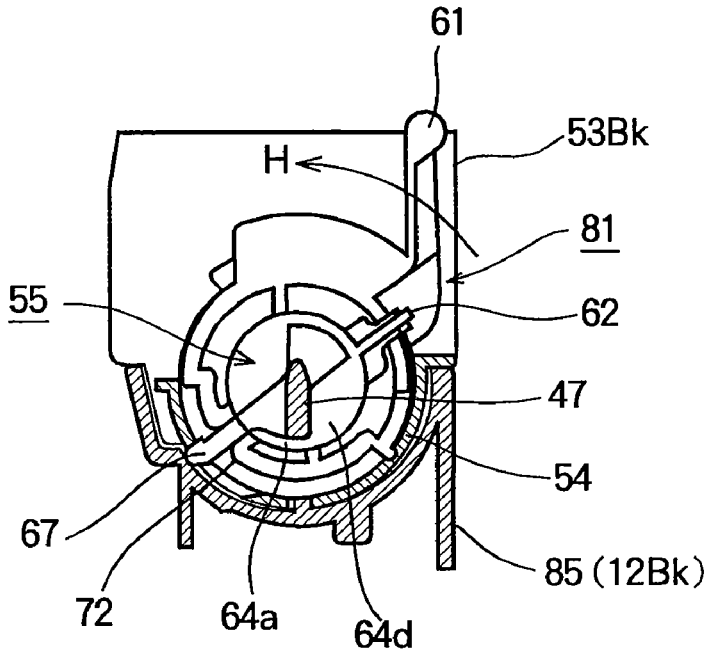
FIG. 26 is a fifth view illustrating the operation for mounting the developer cartridge to the image forming unit according to the second embodiment of the present invention.
Figure 27:
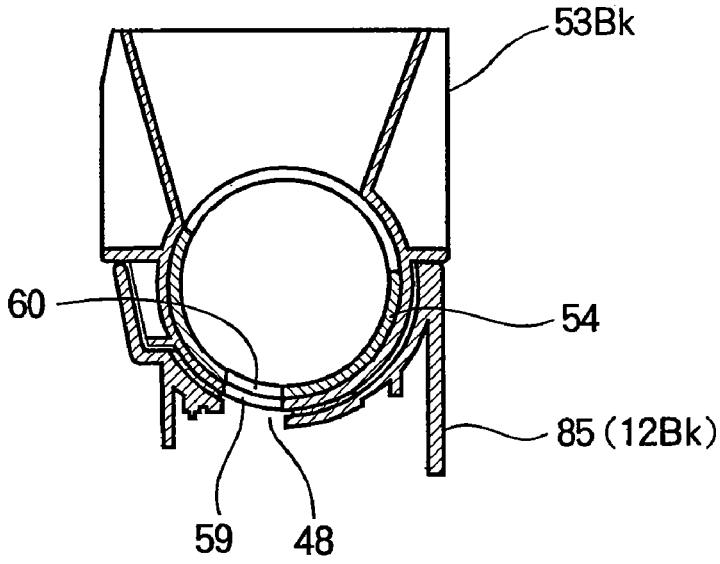
FIG. 27 is a fifth sectional view illustrating the state of the toner supplying opening according to the second embodiment of the present invention.

FIG. 18 is a first view illustrating the operation for mounting the developer cartridge to the image forming unit according to the second embodiment of the present invention. FIG. 19 is a first sectional view illustrating the state of the toner supplying opening according to the second embodiment of the present invention. FIG. 20 is a second view illustrating the operation for mounting the developer cartridge to the image forming unit according to the second embodiment of the present invention. FIG. 21 is a second sectional view illustrating the state of the toner supplying opening according to the second embodiment of the present invention. FIG. 22 is a third view illustrating the operation for mounting the developer cartridge to the image forming unit according to the second embodiment of the present invention. FIG. 23 is a third sectional view illustrating the state of the toner supplying opening according to the second embodiment of the present invention. FIG. 24 is a fourth view illustrating the operation for mounting the developer cartridge to the image forming unit according to the second embodiment of the present invention. FIG. 25 is a fourth sectional view illustrating the state of the toner supplying opening according to the second embodiment of the present invention. FIG. 26 is a fifth view illustrating the operation for mounting the developer cartridge to the image forming unit according to the second embodiment of the present invention. FIG. 27 is a fifth sectional view illustrating the state of the toner supplying opening according to the second embodiment of the present invention.

The above described FIGS. 18, 20, 22, 24 and 26 show the state of the vicinity of the engaging member 55 when the operating portion 61 is operated. The above described FIGS. 19, 21, 23, 25 and 27 show the relationship between the developer cartridge 53Bk and the main body 85 of the image forming unit 12Bk when the operating portion 61 is operated. In FIGS. 18, 20 and 22, the engaging member 55 does not engage the rib (i.e., to-be-engaged portion) 47, and the toner supplying opening 59 is in the closing position. In FIG. 24, the engaging member 55 engages the rib 47, and the toner supplying opening 59 is in the closing position. In FIG. 26, the engaging member 55 engages the rib 47, and the toner supplying opening 59 is in the opening position.

An arcuate-shaped sidewall rib (i.e., a regulating member) 64*a* is formed adjacent to the opening groove 64. Another arcuate-shaped sidewall rib 64*b* is formed in opposition to the sidewall rib 64*a*. Sector-shaped sidewall ribs 64*c* and 64*d* are formed inside the sidewall ribs 64*a* and 64*b* and protrude inwardly.

When the developer cartridge 53Bk is not mounted to the main body 85 of the image forming unit 12Bk, the lock portion 67 engages the cutout portion 66 as shown in FIG. 16, and the lock portion 62 abuts against a rotation stopper rib 69 formed on the operating portion 61 as shown in FIG. 17. Therefore, the inner barrel member 54 does not rotate with respect to the outer barrel member 56 in the direction shown by an arrow G in FIG. 20.

Further, a rotation stopper rib 68 formed on the outer barrel member 56 abuts against a rotation stopper rib 70 formed on the inner barrel member 54, and the inner barrel member 54 does not rotate in the direction opposite to the direction shown by the arrow G (FIG. 20). In this state, the opening 60 and the toner supplying opening 59 are not aligned to each other as shown in FIG. 19, and therefore the toner supplying opening 59 is closed.

When the developer cartridge 53Bk is mounted to the main body 85 of the image forming unit 12Bk, the rib 47 is inserted into the opening groove 64 via the opening groove guide 65, and the developer cartridge 53Bk abuts against the main body 85 of the image forming unit 12Bk.

In this state, as shown in FIG. 20, the lock portion 67 is pressed inwardly by a projection 51 formed on the cartridge mounting portion 46 and is deformed, so that the engagement between the lock portion 67 and the cutout portion 66 is released. Therefore, the inner barrel member 54 becomes rotatable with respect to the outer barrel member 56 in the direction shown by the arrow G, in a state where the lock portion 62 is pressed by the rotation stopper rib 69 in accordance with the rotation of the operating portion 61.

In this regard, the engaging member 55 is not relatively rotatable with respect to the inner barrel member 54 in the direction shown by the arrow G, since the lock portion 62 abuts against the projection 63.

Further, as shown in FIG. 21, the opening 60 and the toner supplying opening 59 are not aligned to each other, and therefore the toner supplying opening 59 is closed. When the operating portion 61 is rotated in the direction shown by the arrow G in FIG. 20, the engaging member 55 reaches the state shown in FIG. 26.

If the lock portion 62 is pulled in the direction shown by an arrow J in FIG. 22 by means of a tool or the like in a state where the lock portion 62 abuts against the projection 63, the lock portion 62 moves beyond the projection 63, and therefore the engaging member 55 becomes rotatable with respect to the inner barrel member 54 in the direction shown by the arrow G (FIG. 20).

When the engaging member 55 is rotated with respect to the inner barrel member 54 in the direction shown by the arrow G, the engaging member 54 reaches the state shown in FIG. 24. The rib 47 engages the sidewall ribs 64*a*, and the lock portion 62 abuts against the rotation stopper rib 71 formed on the inner barrel member 54, so that further rotation of the engaging member 55 is prevented. As shown in FIG. 25, the developer cartridge 53Bk can be mounted to the main body 85 of the image forming unit 12Bk in such a manner that the toner supply opening 59 is closed. In this state, the lock portion 67 engages a cutout portion 72 formed on the circumference of the outer barrel member 56, and is released from the resilient deformation. Therefore, creep deformation of the lock portion 67 can be prevented. Further, the opening 60 and the toner supplying opening 59 are not aligned to each other, and therefore the toner supplying opening 59 is closed.

Then, when the operating portion 61 is rotated in the direction shown by the arrow G (FIG. 20), the rib 47 abuts against the sidewall rib 64*d* as shown in FIG. 26, and the rotation of the operating portion 61 is regulated. As shown in FIG. 27, the opening 60 faces the toner supply opening 59, and therefore the opening 60 and the toner supply opening 59 are aligned to each other, with the result that the toner supply opening 59 is opened.

In this state, when the operating portion 61 is rotated in the direction shown by the arrow H in FIG. 26, the engaging member 55 reaches the state shown in FIG. 20. The rib 47 abuts against the sidewall rib 64*c*, and further rotation of the operating portion 61 is prevented.

In the state shown in FIG. 20, the lock portion 62 abuts against the projection 63 as described above, and therefore the engaging member 55 is not rotatable with respect to the inner barrel member 54 in the direction shown by the arrow G, unless the lock portion 62 is pulled upward in the direction shown by the arrow J (FIG. 22). In the state shown in FIG. 24, since the contact surfaces of the lock portion 62 and the projection 63 are slightly tapered with respect to the moving direction of the lock portion 62, the engaging member 55 is rotatable in the direction shown by the arrow H (FIG. 26) with respect to the inner barrel member 54, without pulling the lock portion 62 upward in the direction shown by the arrow J (FIG. 22).

Since the image forming unit 12Bk is configured as above, the developer cartridge 53Bk can be mounted to the main body 85 of the image forming unit 12Bk, by operating the operating portion 61 in the order of steps shown in FIGS. 18, 20, 22 and 24, and the image forming unit 12Bk can be shipped in a state shown in FIG. 24.

Then, when the user starts using the image forming unit 12Bk, the user operates the operating portion 61 (from the state shown in FIG. 24) as shown in FIG. 26. With such an operation, the toner supply opening 59 can be opened in a state where the developer cartridge 53Bk is mounted to the main body 85 of the image forming unit 12Bk.

Further, when the user replaces the developer cartridge 53Bk, the user operates the operating portion 61 (from the state shown in FIG. 26) in the order of steps shown in FIGS. 20 and 18 to close the toner supplying opening 59 and then removes the old (used) developer cartridge 53Bk from the main body 85 of the image forming unit 12Bk. Then, the user mounts new developer cartridge 53Bk to the main body 85 of the image forming unit 12Bk as shown in FIG. 18, and operates the operating portion 39 (from the state shown in FIG. 18) in the order of steps shown in FIGS. 20 and 26 to open the toner supplying opening 59.

In this operation, the user does not need to perform the operation of the steps shown in FIGS. 20, 22 and 24, and therefore the user can replace the developer cartridge 53Bk in a similar manner to the conventional replacing operation of the developer cartridge.

As described above, in the manufacturing process of the second embodiment, the developer cartridge 53Bk can be mounted to the main body 85 of the image forming unit without changing the position of the operating portion 61 (see FIGS. 20, 22 and 24), in such a manner that the toner supplying opening 59 is closed. Therefore, the operation can be simplified.

In the above described embodiments, although the waste toner is stored in the waste toner chamber 52 (58) provided in the developer cartridge 21Bk (53Bk), the present invention is applicable to the developer cartridge having no waste toner chamber.

Further, in the above described embodiments, the printer is described as an example of an image forming apparatus. However, the present invention is applicable to a copier, a facsimile machine, a combined machine or the like.

While the preferred embodiments of the present invention have been illustrated in detail, it should be apparent that modifications and improvements may be made to the invention without departing from the spirit and scope of the invention as described in the following claims.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A developer cartridge comprising:

an outer barrel member;

an inner barrel member rotatably provided with respect to said outer barrel member; and a regulating member rotatably provided with respect to said inner barrel member, said regulating member including a first engaging portion and a second engaging portion, wherein said inner barrel member includes a first to-be-engaged portion that engages said first engaging portion, and further includes an operating member, wherein said outer barrel member includes a second to-be-engaged portion that engages said second engaging portion, wherein said first engaging portion and said first to-be-engaged portion are configured to define a position of the regulating member by engagement between said first engaging portion and said first to-be-engaged portion;

wherein, when said first engaging portion and said first to-be-engaged portion engage each other, and engagement between said second engaging portion and said second to-be-engaged portion is released, said inner barrel member is rotatable together with said regulating member with respect to said outer barrel member, and wherein, when engagement between said first engaging portion and said first to-be-engaged portion is released, and engagement between said second engaging portion and said second to-be-engaged portion is released, said regulating member is rotatable with respect to said inner barrel member.

2. The developer cartridge according to claim 1, wherein said outer barrel member includes a developer storing portion for storing a developer and a first opening for ejecting said developer, wherein said inner barrel member includes a second opening, wherein, when said first engaging portion and said first to-be-engaged portion engage each other, and engagement between said engaging portion and said second to-be-engaged portion is released, said inner barrel member is rotatable together with said regulating member with respect to said outer barrel member by operation of said operating member and enables said first opening and said second opening to be aligned with each other to cause said developer to be ejected.

3. The developer cartridge according to claim 2, wherein release of engagement between said first engaging portion of said regulating member and said first to-be-engaged portion of said inner barrel member performed by action from outside of said developer cartridge allows said regulating member to rotate in a first direction, wherein, when said regulating member rotates in a direction opposite to said first direction, said first engaging portion of said regulating member and said first to-be-engaged portion of said inner barrel member engage each other.

4. The developer cartridge according to claim 3, wherein said first engaging portion is composed of a resilient member and said first to-be engaged portion has an inclined surface that contacts said first engaging portion.

5. The developer cartridge according to claim 3, wherein release of engagement between said first engaging portion and said first to-be-engaged portion is performed using a tool from outside of said developer cartridge.

6. The developer cartridge according to claim 2, wherein said regulating member has a receiving portion that receives a third engaging portion of an external unit when said developer cartridge is mounted to said external unit, wherein engagement between said second engaging portion and said second to-be engaged portion is released by a fourth engaging portion of said external unit that pushes said second engaging portion, wherein, when said first engaging portion and said first to-be engage portion engage each other and engagement between said second engaging portion and said second to-be-engaged portion is released, said developer cartridge is prevented from being detached from said external unit.

7. The developer cartridge according to claim 6, wherein, when engagement between said first engaging portion and said first to-be-engaged portion is released and said engagement between said second engaging portion and said second to-be-engaged portion is released, said regulating member is rotatable with respect to said inner barrel member, said developer cartridge is prevented from being detached from said unit, and said first and second openings are prevented from being aligned with each other.

8. The developer cartridge according to claim 7, wherein engagement between said second engaging portion and second to-be-engaged portion is released by said fourth engaging portion of said external unit when the fourth engaging portion pushes said second engaging portion.

9. The developer cartridge according to claim 2, wherein said outer barrel member includes a first storing chamber for storing a fresh developer and a second storing chamber for storing a waste developer, and wherein said first opening is formed on said first storing chamber.

10. The developer cartridge according to claim 1, wherein said second engaging portion is composed of a resilient member and said second to-be-engaged portion includes a groove portion for receiving said second engaging portion.

11. An image forming unit comprising said developer cartridge according to claim 1.

12. An image forming apparatus comprising said image forming unit according to claim 11.

13. The developer cartridge according to claim 1, wherein at least a portion of the regulating member is positioned inside the inner barrel member.

* * * * *